US009796523B2

(12) United States Patent
Benoit et al.

(10) Patent No.: US 9,796,523 B2
(45) Date of Patent: Oct. 24, 2017

(54) CASE

(75) Inventors: Erica Yvette Benoit, Marietta, GA (US); Eddy Benoit, Jr., Marietta, GA (US); David Scott Rowley, Powder Springs, GA (US); Zachary Adam Griggs, Atlanta, GA (US)

(73) Assignee: FFLOX, INC., Atlanta, GA (US)

( * ) Notice: Subject to any disclaimer, the term of this patent is extended or adjusted under 35 U.S.C. 154(b) by 228 days.

(21) Appl. No.: 13/536,347

(22) Filed: Jun. 28, 2012

(65) Prior Publication Data

US 2013/0140202 A1 Jun. 6, 2013

Related U.S. Application Data

(60) Provisional application No. 61/502,589, filed on Jun. 29, 2011.

(51) Int. Cl.

| | |
|---|---|
| ***B65D 85/18*** | (2006.01) |
| ***A45C 5/00*** | (2006.01) |
| ***B65D 21/08*** | (2006.01) |
| ***B65D 25/04*** | (2006.01) |
| ***B65D 25/10*** | (2006.01) |
| ***A45C 7/00*** | (2006.01) |
| ***A45C 13/03*** | (2006.01) |

(52) U.S. Cl.

CPC ..... *B65D 85/187* (2013.01); *A45C 5/00* (2013.01); *A45C 7/0027* (2013.01); *A45C 13/03* (2013.01); *B65D 21/086* (2013.01); *B65D 25/04* (2013.01); *B65D 25/102* (2013.01); *B65D 2205/02* (2013.01)

(58) Field of Classification Search

CPC ..... A45C 13/00; A45C 13/02; B65D 85/18

See application file for complete search history.

(56) References Cited

U.S. PATENT DOCUMENTS

| | | | | | |
|---|---|---|---|---|---|
| 766,242 | A | * | 8/1904 | Gordon | 206/293 |
| 1,764,251 | A | * | 6/1930 | Farago | B65D 5/46056 206/292 |
| 1,980,714 | A | * | 11/1934 | Brady | 190/109 |
| 2,339,907 | A | * | 1/1944 | Bracken | 190/28 |
| 2,350,606 | A | * | 6/1944 | Gold | A45C 3/004 190/115 |
| 3,126,077 | A | * | 3/1964 | Marshall | A45C 5/02 190/125 |
| 3,749,232 | A | * | 7/1973 | Craig | A45C 3/12 220/324 |
| D235,622 | S | | 7/1975 | Herring | |
| 4,061,170 | A | * | 12/1977 | Marks | A45C 11/00 206/278 |
| D252,115 | S | | 6/1979 | Herring | |
| 4,461,332 | A | * | 7/1984 | Parkhurst | A45C 3/00 132/314 |
| 4,854,432 | A | * | 8/1989 | Carpenter et al. | 190/110 |

(Continued)

OTHER PUBLICATIONS

Image File Wrapper of U.S. Design U.S. Appl. No. 29/413,348; electronically captured from PAIR on Jul. 13, 2017.

*Primary Examiner* — Tri Mai

(74) *Attorney, Agent, or Firm* — DLA PIPER LLP (US)

(57) ABSTRACT

A case comprising a first housing, a second housing attached to the first housing, a liner on the inside of the first housing and/or second housing, and a strap attached to the first housing and/or second housing, the strap being constructed and arranged to secure footwear.

19 Claims, 19 Drawing Sheets

(56) References Cited

U.S. PATENT DOCUMENTS

| | | | | | |
|---|---|---|---|---|---|
| 4,881,637 | A * | 11/1989 | Peters | A45C 3/12 | 206/278 |
| 5,197,661 | A * | 3/1993 | Sanchez | B65D 3/28 | 229/117.25 |
| 5,228,547 | A * | 7/1993 | Yoo | A45C 3/00 | 190/103 |
| 5,437,367 | A * | 8/1995 | Martin | 206/320 | |
| 5,474,162 | A * | 12/1995 | Shyr et al. | 190/18 A | |
| 5,779,036 | A * | 7/1998 | Westbrook et al. | 206/292 | |
| 5,930,915 | A * | 8/1999 | Dhaemers | A43D 3/1491 | 34/202 |
| 6,009,996 | A * | 1/2000 | Purdy | 206/317 | |
| 6,644,448 | B2 * | 11/2003 | Bernbaum | A45C 3/00 | 190/111 |
| 6,874,628 | B2 * | 4/2005 | Hammill | 206/317 | |
| 7,086,255 | B2 * | 8/2006 | Reason | A44B 19/301 | 211/4 |
| 7,243,815 | B2 * | 7/2007 | Coppedge | B65D 75/22 | 220/769 |
| D592,398 | S | 5/2009 | Roesler | | |
| D592,399 | S | 5/2009 | Sage | | |
| D636,182 | S | 4/2011 | Yang | | |
| D636,598 | S | 4/2011 | Tseng et al. | | |
| D661,897 | S | 6/2012 | Kohler et al. | | |
| 8,220,625 | B2 | 7/2012 | Michaels et al. | | |
| 8,413,776 | B1 * | 4/2013 | Huff | A45C 13/00 | 150/113 |
| 2007/0039841 | A1 * | 2/2007 | Deloatch-Ratliff | B65D 85/187 | 206/278 |
| 2007/0151871 | A1 * | 7/2007 | Brawley | 206/37 | |
| 2012/0096614 | A1 * | 4/2012 | Sebasco | 2/16 | |

* cited by examiner

*Note: Housing Parts are identical so only a single tool is needed for initial manufacturing Foam Liner
Attachment
Detail Hinge Detail Side release buckle Low profile buckle

CASE

CROSS-REFERENCE TO RELATED APPLICATIONS

This application claims the benefit of U.S. Provisional Application No. 61/502,589, filed Jun. 29, 2011, which is incorporated by reference in its entirety.

DETAILED DESCRIPTION

Figure 1:
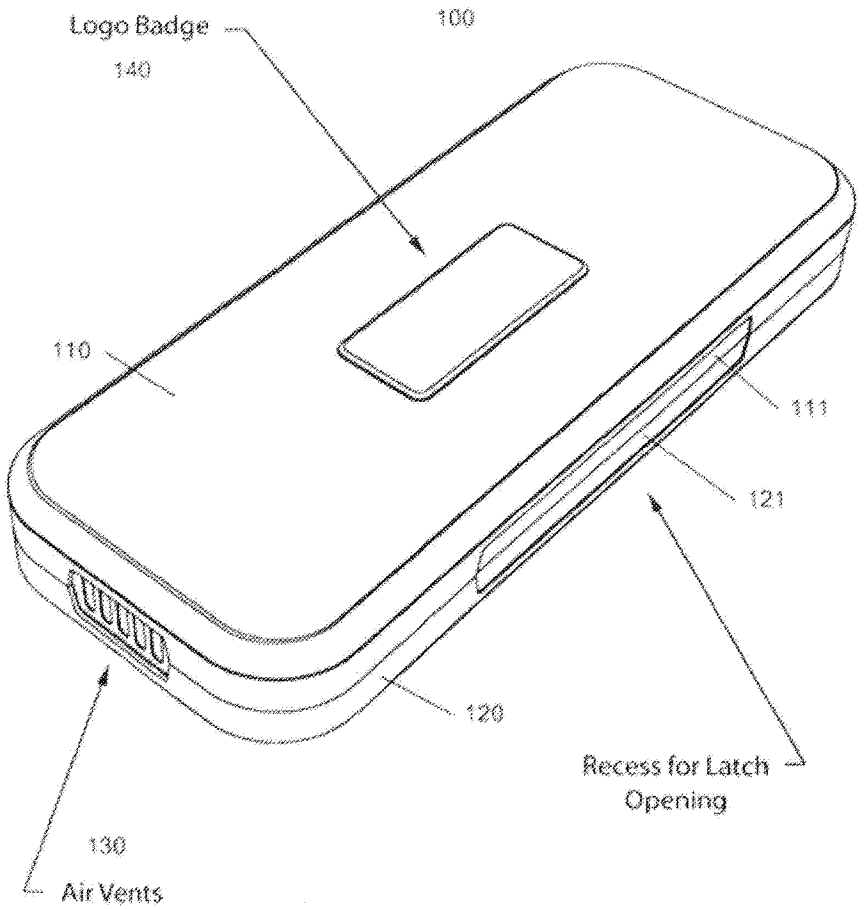
FIG. 1 depicts a footwear case according to an embodiment of the invention.

FIG. 1 depicts an external view of a footwear container or case 100 according to an embodiment of the invention. The case 100 may be sized to enclose one or more pairs of footwear. In some embodiments, the case 100 may be sized to enclose a single pair of flip flops or other flat footwear. A case 100 may be sized to enclose a particular size and/or style of footwear, or it may be made large enough to enclose any of a variety of different sizes and/or styles of footwear. The case 100 may be used to enclose objects other than footwear. The exterior of the case 100 may be finished using any finish, (e.g., molded plastic, rubber, metal, fabric, leather, a glossy surface, or other finishes, or any combination thereof). The exterior of the case 100 may comprise at least a first housing 110 and a second housing 120. One or more portions of the first housing 110 and the second housing 120 may be recessed. For example, in some embodiments, a first housing recess 111 and second housing recess 121 may be formed in the first housing 110 and the second housing 120, respectively, near a location where the first housing 110 and second housing 120 meet. This can be used, for example, to help open and shut the case 100. One or more vents 130 may be disposed in the case 100 in either the first housing 110, the second housing 120, or both. In some embodiments, a logo 140 or other marking may be placed or formed on either the first housing 110, the second housing 120, or both. In some embodiments, the case 100 may include one or more handles, straps, attachment hooks, eyelets, subdividers, screens, interior rubber/plastic liners with antimicrobial sprayed coating, similar features, or combinations thereof which may facilitate carrying or attachment to another object.

Figure 2A:
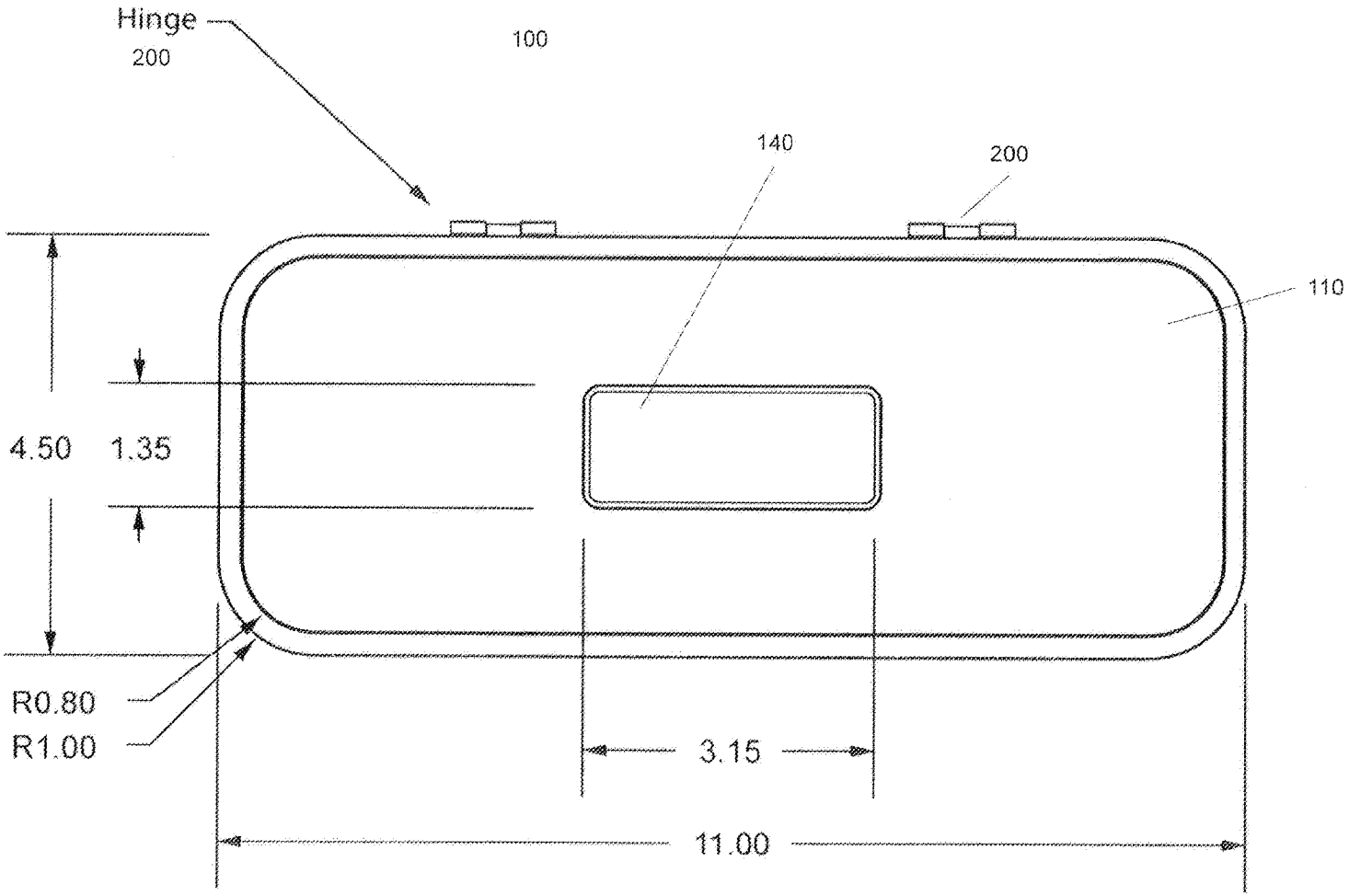
FIG. 2A depicts a top view of a footwear case according to an embodiment of the invention.
Figure 2B:
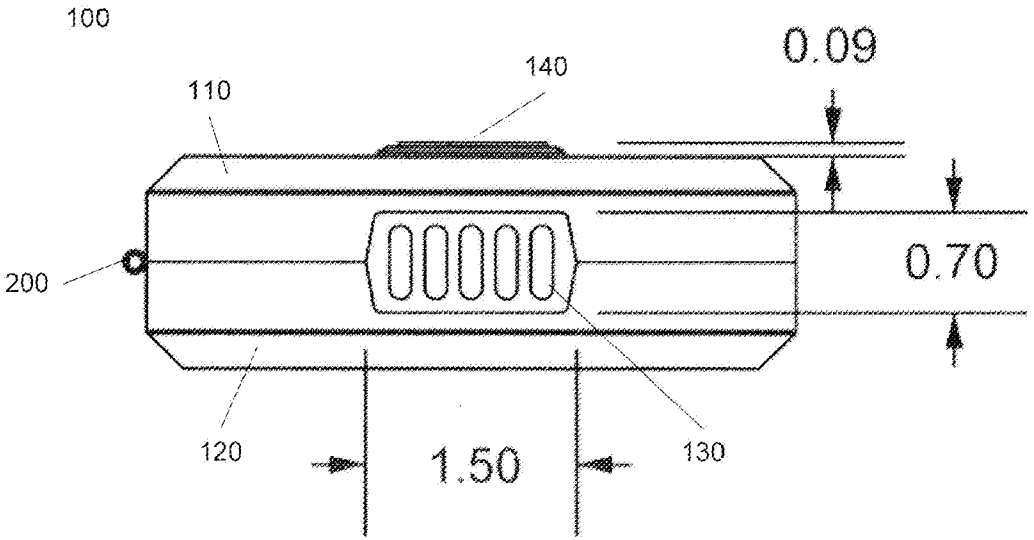
FIG. 2B depicts a side view of a footwear case according to an embodiment of the invention.
Figure 2C:
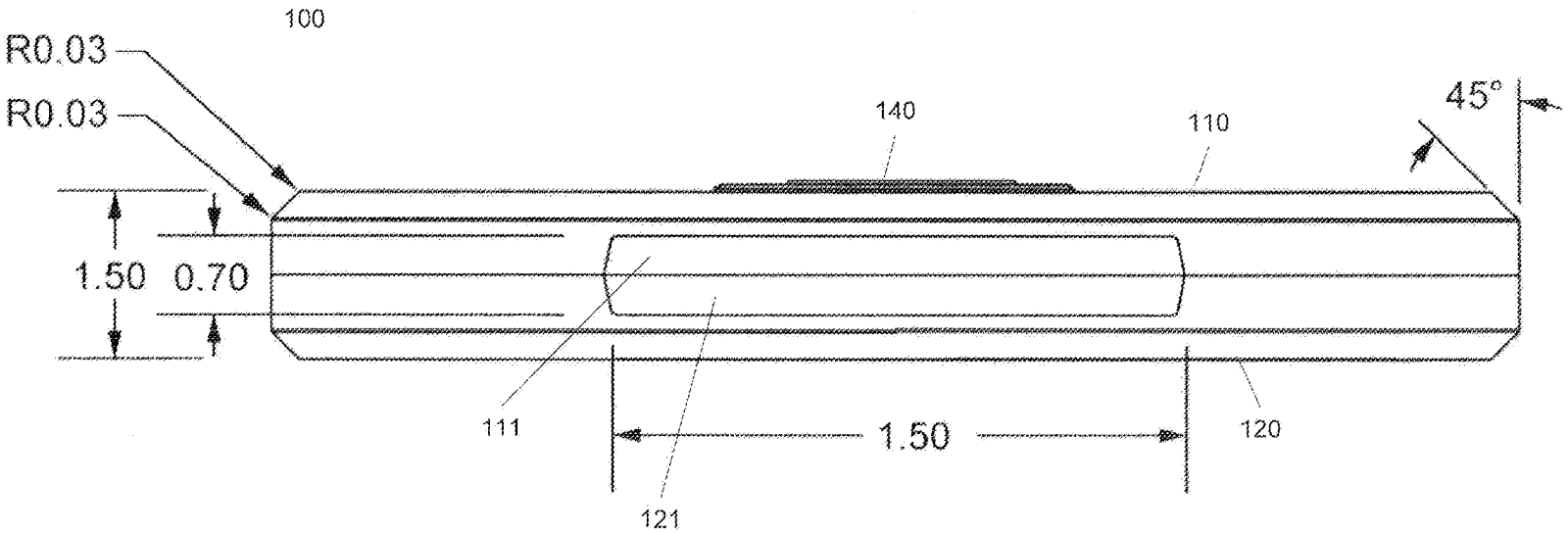
FIG. 2C depicts a front view of a footwear case according to an embodiment of the invention.

FIG. 2A depicts a top view of a footwear case 100 according to an embodiment of the invention. In some embodiments, hinges 201 may be used to connect the first housing 110 and second housing 120. One or more hinges 201 may be disposed along a side of the case 100. The hinges 201 may allow the case 100 to be opened and closed. In some embodiments, the hinges 201 may be disposed on a side parallel to and/or opposite from a side having a first housing recess 111 and/or a second housing recess 121. (Note that the measurements illustrated on FIGS. 2A, 2B and 2C are merely example measurements that may be used in one embodiment. Those of ordinary skill in the art will see that multiple other measurements may be utilized.)

FIG. 2B depicts a side view of a footwear case 100 according to an embodiment of the invention. In this view, it can be seen that the hinges 201 may join the first housing 110 and second housing 120.

FIG. 2C depicts a front view of a footwear case 100 according to an embodiment of the invention. In this view (and in FIG. 2B), it can be seen that in some embodiments the logo 140 may be: raised with respect to first housing 110 and/or second housing 120, in relief with respect to first housing 110 and/or second housing 120, on the same surface as first housing 110 and/or second housing 120 (e.g., flat), sunk with respect to the first housing 110 and/or second housing 120, or in counter relief with respect to the first housing 110 and/or the second housing 120, or any combination thereof.

Figure 3:
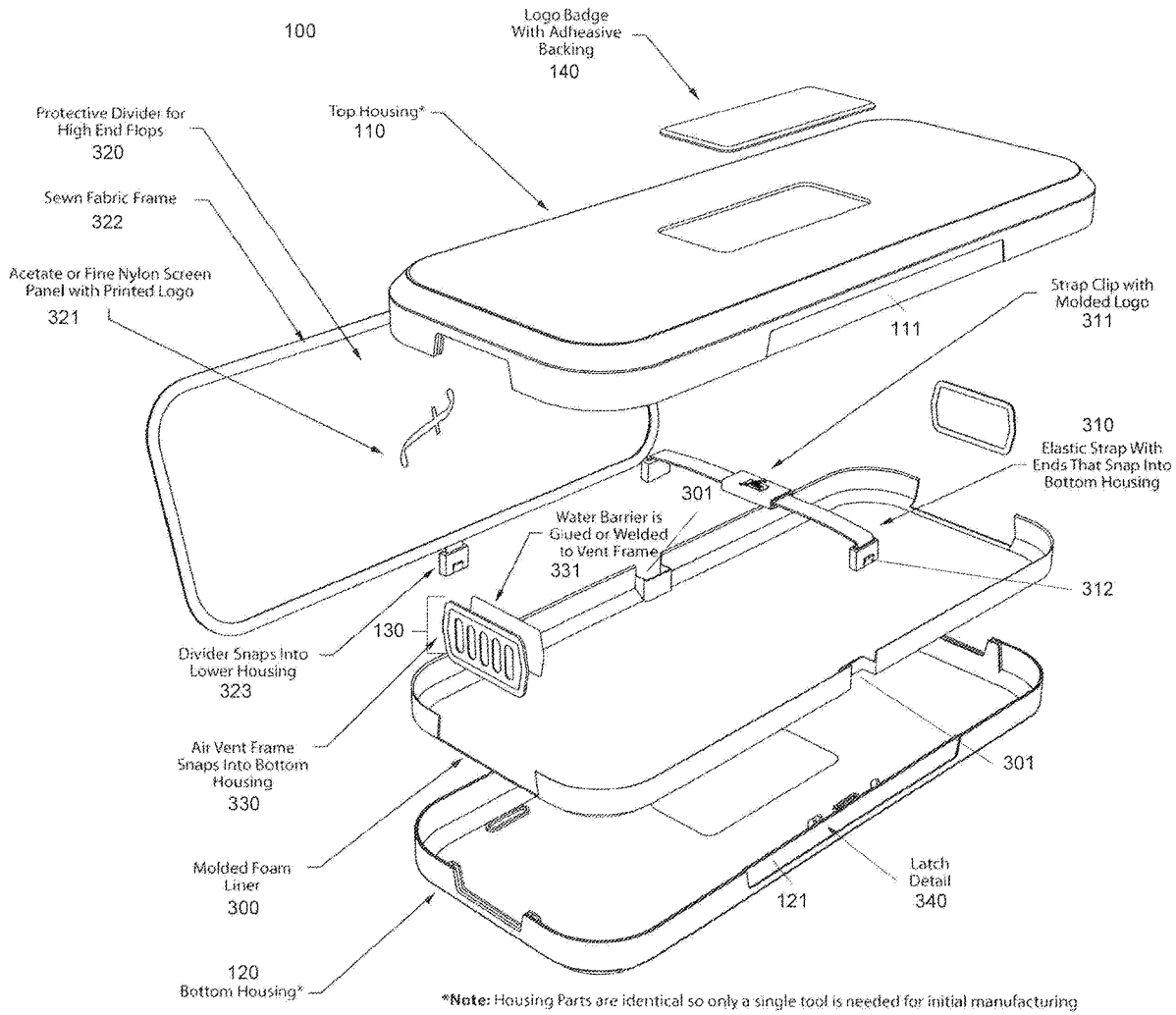
FIG. 3 depicts an exploded view of a footwear case according to an embodiment of the invention.

FIG. 3 depicts an exploded view of a footwear case 100 according to an embodiment of the invention. The logo 140 may be a separate part from the case 100 and may be attached to the case 100 by an adhesive, mechanical fastener, or in some other fashion, or any combination thereof. In other embodiments, the logo 140 may be integrally formed as part of the first housing 110 and/or the second housing 120.

Figure 6:
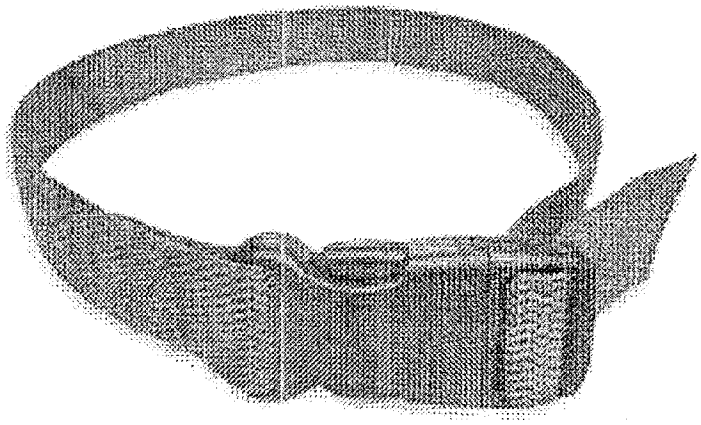
FIGS. 6 and 7 depict examples of buckles, according to an embodiment of the invention.
Figure 7:
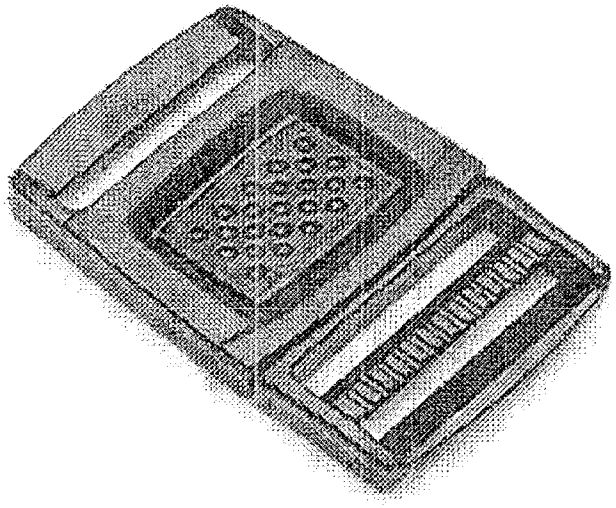

In some embodiments, one or more liners 300 may be disposed within the case 100. In some embodiments, one or more liners 300 may be attached to the inside of the first housing 110, the second housing 120, or both: For example, the liners 300 may be over-molded onto plastic housings (e.g., at the top and/or bottom). The liners 300, which can be molded within the case and have a antimicrobial spray agent, may be made of molded foam or some other material. For example, the liners 300 may be molded of a thermoplastic elastomer (TPE), of an ethylene-vinyl acetate (EVA), or of any combination thereof. (For more information on the TPE, see, e.g., http://en.wikipedia.org/wiki/Thermoplastic_elastomer, which is herein incorporated by reference.) For more information on the EVA, see, e.g., http://en.wikipedia.org/wiki/Ethylene-vinyl_acetate, which is also herein incorporated by reference.) The liners 300 may be made from a material that is resistant to mold, mildew, and/or fungus in some embodiments. In some other embodiments, the liners 300 may be treated to become resistant to mold, mildew, and/or fungus. In some other embodiments, additional components of the case 100 may be mold, mildew, and/or fungus resistant. For example, the liners 300 may be made of or have added an antimicrobial additive to provide resistance to mold and mildew. (For more information on antimicrobial additives, see, e.g., http://www.microban.com/americas/english/products/, which is herein incorporated by reference.) In some embodiments, one or more straps 310 may be disposed within the case 100. The straps 310 may be made of elastic or another material that may stretch to securely hold objects of varying shapes. The straps 310 may include a fastener 311. The fastener may permit the straps 310 to be opened and closed. The fastener 311 may comprise: a side release buckle (e.g., FIG. 6), a low profile buckle (e.g., FIG.

7), or a metal hook that hooks onto a metal loop. The fastener may comprise clips, VELCRO, or another material. The fasteners 311 may be formed with logos or designs in some embodiments. The straps 310 may include ends 312 which attach the straps 310 to the liners 300 and/or the first housing 110 or second housing 120. For example, in some embodiments one or more straps 310 may attach to the first housing 110 and one or more straps may attach to the second housing 120, so that one or more pieces of footwear or other objects may be secured to each of the first housing 110 and the second housing 120. In some embodiments, the ends 312 may allow the straps 310 to be detached from and reattached to the liners 300 and/or first housing 110 or second housing 120. In embodiments wherein the ends 312 are attached to the first housing 110 or second housing 120, one or more of the liners 300 may include gaps 301 to permit the ends 312 to directly interface with the first housing 110 or second housing 120. Straps 310 may be mold, mildew, and/or fungus resistant.

In some embodiments, one or more dividers 320 may be disposed within the case 100. For example, the dividers 320 may comprise a molded plastic frame that suspends a plastic screen or a sheet of clear or frosted vinyl acetate. The dividers 320 may rotate on one or more hinges that could be integral to the case hinge for the first housing 110 and the second housing 120. In some embodiments, the dividers 320 may be flexible or rotatable and may be used to separate one of a pair of footwear from its mate, for example. Dividers 320 may comprise a screen 321 surrounded or supported by a frame 322. The screen 321 may be made of acetate, fine nylon, or any other suitable material. The frame 322 may be made of sewn fabric or any other suitable material. In other embodiments, dividers 320 may be a single piece. In some embodiments, the dividers 320 may be formed with logos or designs. Dividers 320 may also include attachment points 323 which allow the dividers 320 to be attached to the liners 300 and/or the first housing 110 or second housing 120. Dividers 320 may be mold, mildew, and/or fungus resistant.

Figure 8:
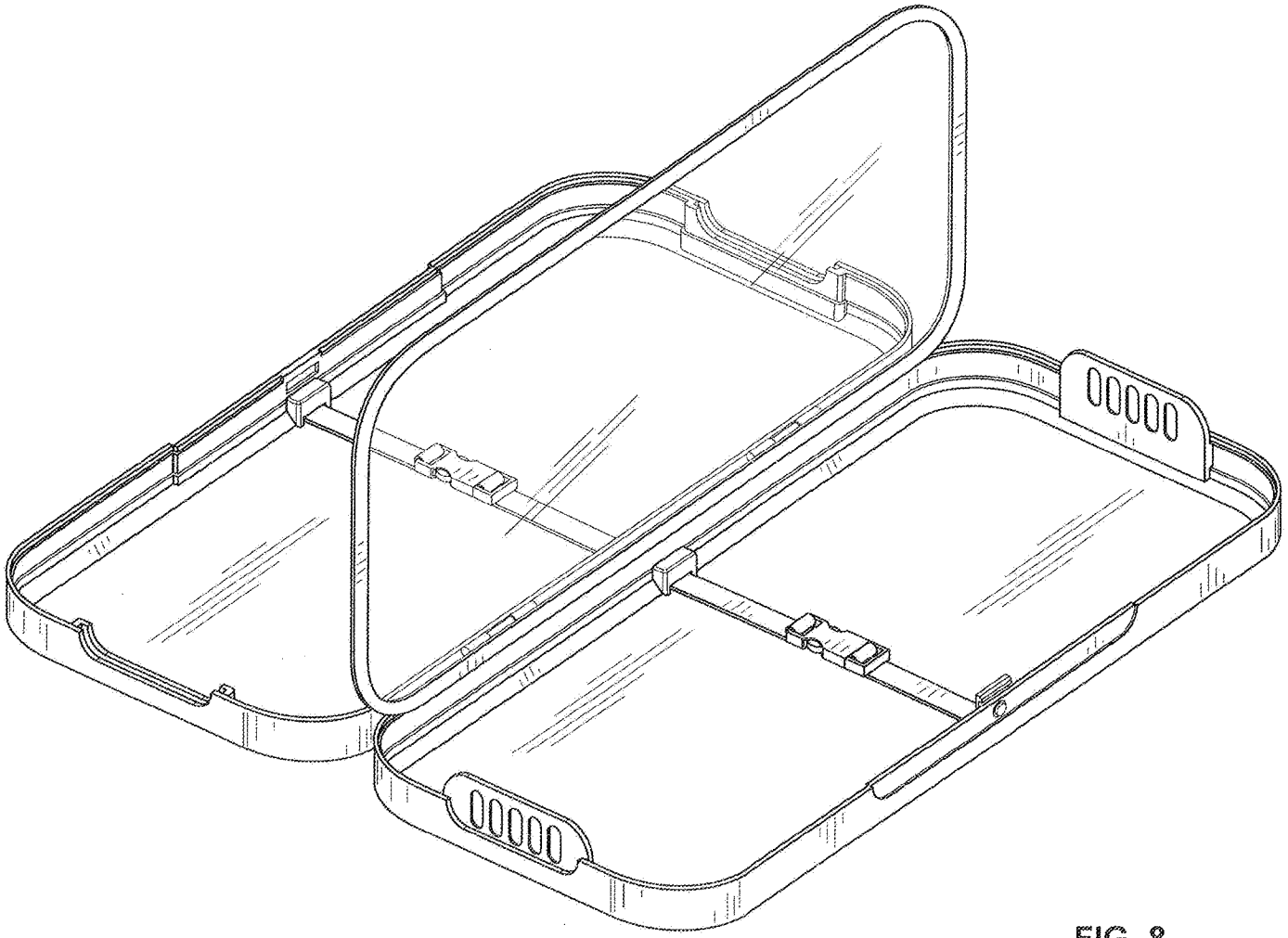
FIGS. 8-9 and 15-22 depict examples of a footwear case, according to embodiments of the invention.
Figure 9:
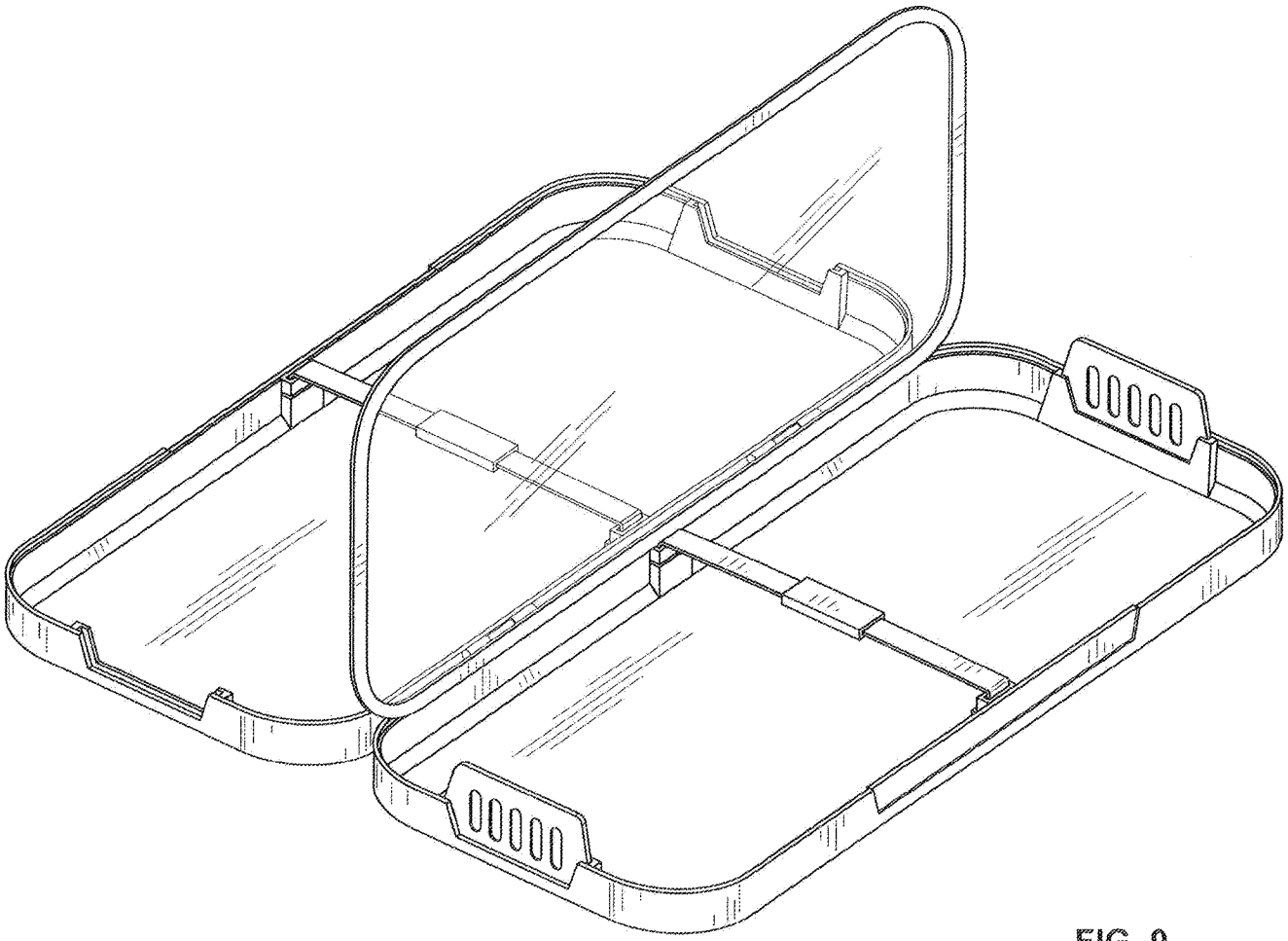

As noted above, one or more vents 130 may be included. In some embodiments, vents 130 may comprise a vent frame 330 and a barrier 331 which may be glued, welded, or attached in some other way to the frame 330. Barriers 331 may be made of a material that forms a barrier to water and/or other fluids: Vents 130 may be attached to a liner 300 and/or the first housing 110 or second housing 120. In some embodiments, vents 130 may be formed or carved into the first housing 110 and/or second housing 120 instead of being separate pieces. Vents 130 may be mold, mildew, and/or fungus resistant. In one example, the vents 130 may be molded into a first housing and/or a second housing 120, with openings created by a side action using an injection molding tool. (For more information, see, e.g., rockywoods.com.) Vent filters may be manufactured using, for example, a plastic frame that sandwiches a light weight, waterproof, breathable nylon fabric. In addition, vent filters could have a secondary, breathable layer of fabric that may include a fragrance or deodorant property that is added to the fabric through a coating process. (See, e.g., www.fitfibers.com/Scented%20Fibers%20-%20University%20of20Philadelphia.pdf, which is herein incorporated by reference.) One or more latches 340 may be included in the case 100. Latches 340 may be formed on the first housing 110 and second housing 120 to permit the case 100 to be closed securely. In some embodiments, latches 340 may be positioned on a side opposite a side having hinges 201. In some embodiments, latches 340 may be positioned on a side wherein the first housing 110 has one or more first housing recesses 111 and the second housing 120 has one or more second housing recesses 121. In one example, as illustrated in FIG. 8, the latches 340 may be an integral snap finger latch comprising a molded snap finger on the second housing 120 near a midpoint of the parting line, and a matching recess molded into the first housing 110. The snap finger may catch on the recess. Release of the latch 340 may be accomplished by deflecting the bottom housing near the midpoint of the parting line (e.g., indicated by a molded dot, bump, etc.), thus disengaging the snap finger from the undercut on the top housing.

Figure 4:
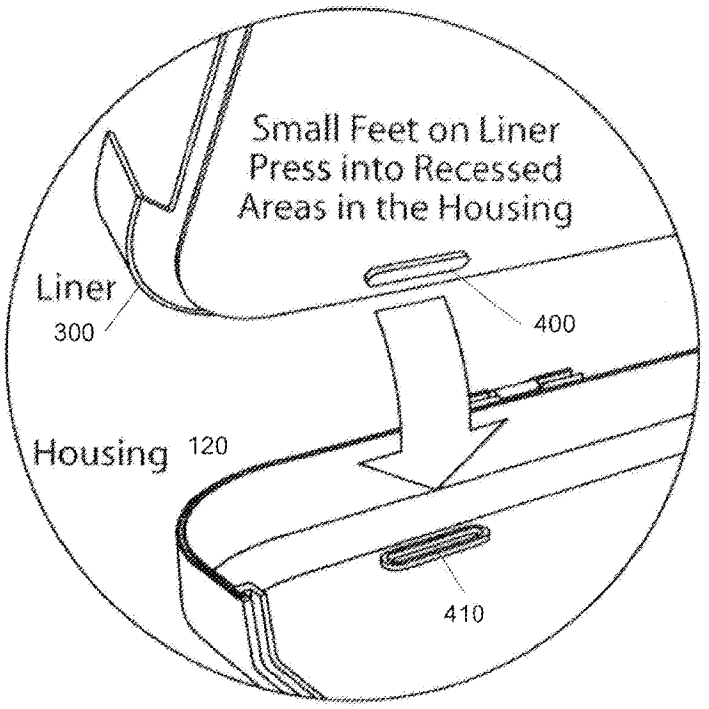
FIG. 4 depicts a liner and housing according to an embodiment of the invention.

FIG. 4 depicts a liner 300 and housing according to an embodiment of the invention. For example, the housing shown is a second housing 120, but the description in this paragraph may also apply to a first housing 110. A liner 300 may include one or more feet 400 on the side of the liner 300 which interfaces with the second housing 120. The feet 400 may extend from the surface of the liner 300. The feet 400 may be integrally formed as part of the liner 300, or they may be separate pieces which are attached to the liner 300. The second housing 120 may include one or more recesses 410. The recesses 410 may be positioned in locations where they may accept the feet 400. The recesses 410 may be shaped in such a way as to accept the feet 400. The recesses 410 may be integrally formed as part of the second housing 120, or they may be separate pieces which are attached to the second housing 120. The feet 400 may fit into the recesses 410 and be removable, or they may be secured using adhesives or other appropriate securing techniques. The feet 400 and recesses 410 may be formed such that there is space between the liner 300 and second housing 120, or they may be formed such that the liner 300 and second housing 120 fit snugly together. In some embodiments, the feet 400 and recesses 410 may be omitted, and the liner 300 and second housing 120 may be attached in some other way.

Figure 5:
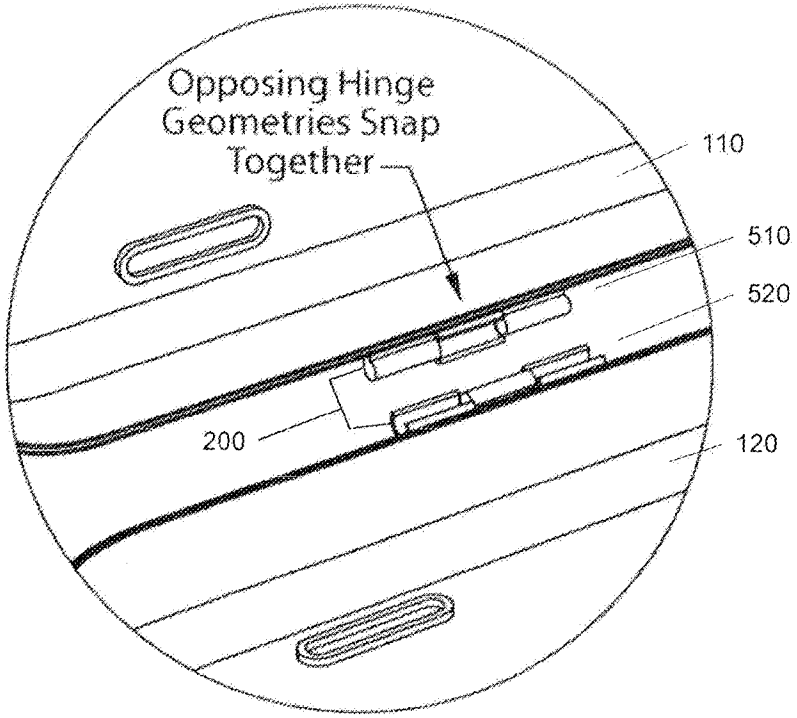
FIG. 5 depicts a hinge according to an embodiment of the invention.

FIG. 5 depicts a hinge 201 according to an embodiment of the invention. The hinge 201 may attach the first housing 110 and second housing 120. The hinge 201 may comprise a first hinge portion 510 having a first hinge geometry disposed on the first housing 110 and a second hinge portion 520 having a second hinge geometry disposed on the second housing 120. The respective hinge geometries may be formed such that the first hinge portion 510 and second hinge portion 520 snap together or are otherwise attachable to one another. The hinge 201 may allow the first housing 110 and second housing 120 to swivel with respect to one another when the first hinge portion 510 and second hinge portion 520 are attached. The hinge portions may be integrally formed as part of the housings or may be separate parts attached to the housings. In other embodiments, other hardware for attaching the first housing 110 and second housing 120 may be provided.

FIG. 8 illustrates a perspective view of a footwear case 100, according to one embodiment. In this embodiment, the latch 340 is illustrated. The latch 340 can be a snap finger latch where there is a molded snap finger on the second housing 120 near the midpoint of the parting line, and a matching recess molded into the first housing 110. The snap finger can catch on the recess. Release of the latch can be accomplished by deflecting the second housing 120 near the midpoint of the parting line (e.g., which can be indicated by a molded dot or bump), thus disengaging the snap finger from the undercut on the top housing. In addition, the vent 130 can be molded, glued, or otherwise attached to the first housing 120.

FIGS. 9 and 15-20 illustrate various views of another footwear case 100, according to another embodiment. In this embodiment, the vent 130 can be inserted into the second housing 120.

Figure 21:
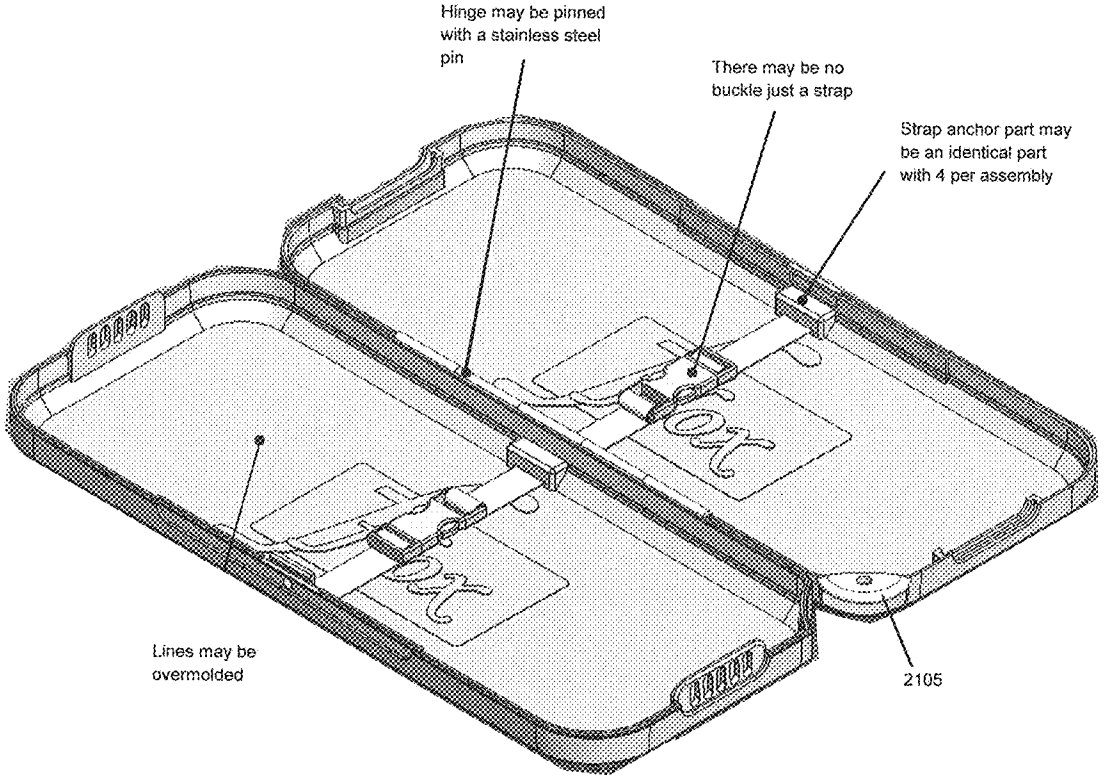
Figure 22:
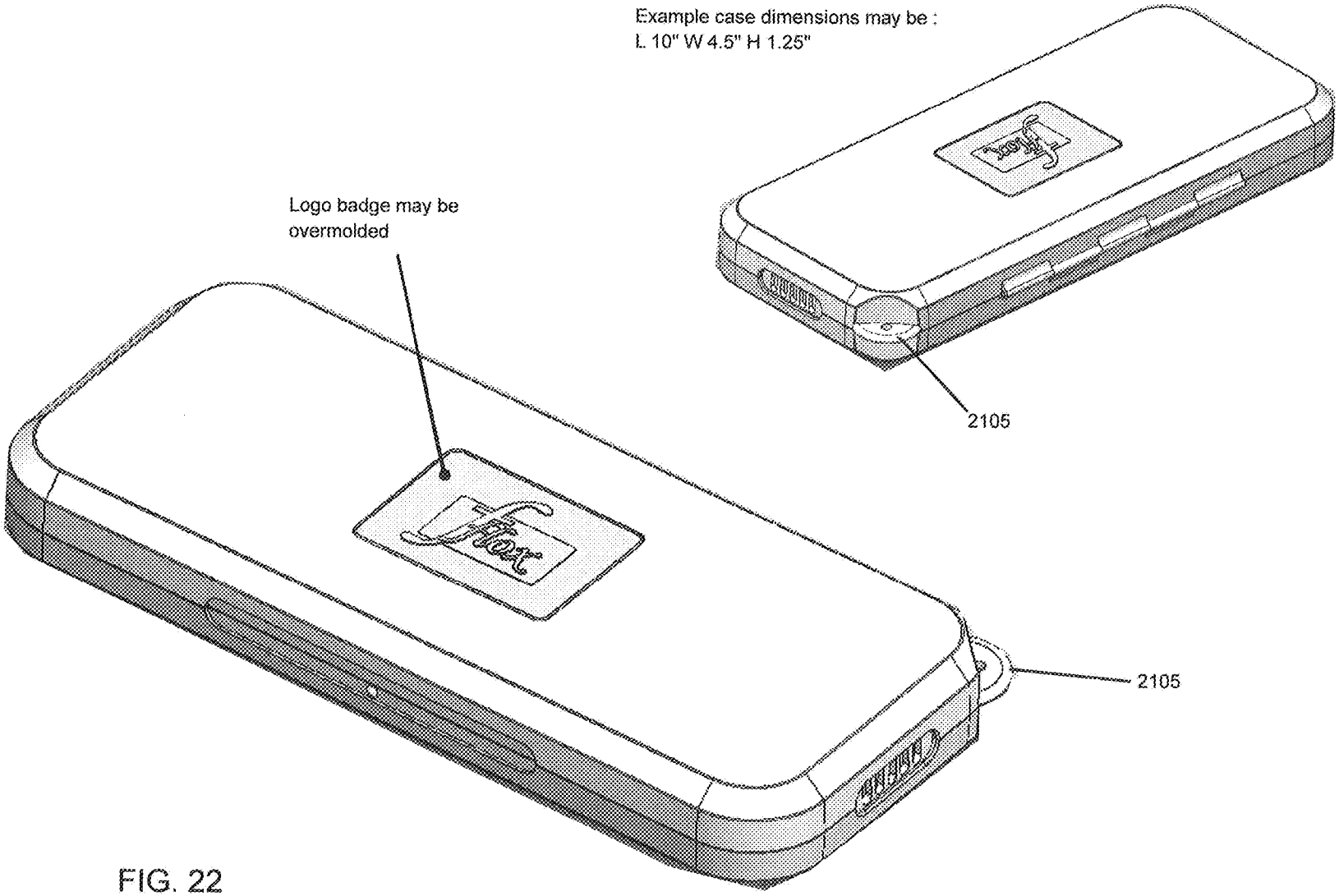

FIGS. 21-22 illustrate various views of another footwear case 100, according to another embodiment. In this embodiment, a mechanism 2105 may be included. The mechanism 2105 may allow a user to attach a ring and/or strap to the footwear case 100. In this way the footwear case 100 may be carried with a strap or attached to something else (e.g., a purse, a piece of luggage). In some embodiments, the mechanism 2105 may be made out of a material used in another component of the footwear case 100. In other embodiment, the mechanism 2105 may be made of a material that is not used in other components of the footwear case 100.

Figure 10:
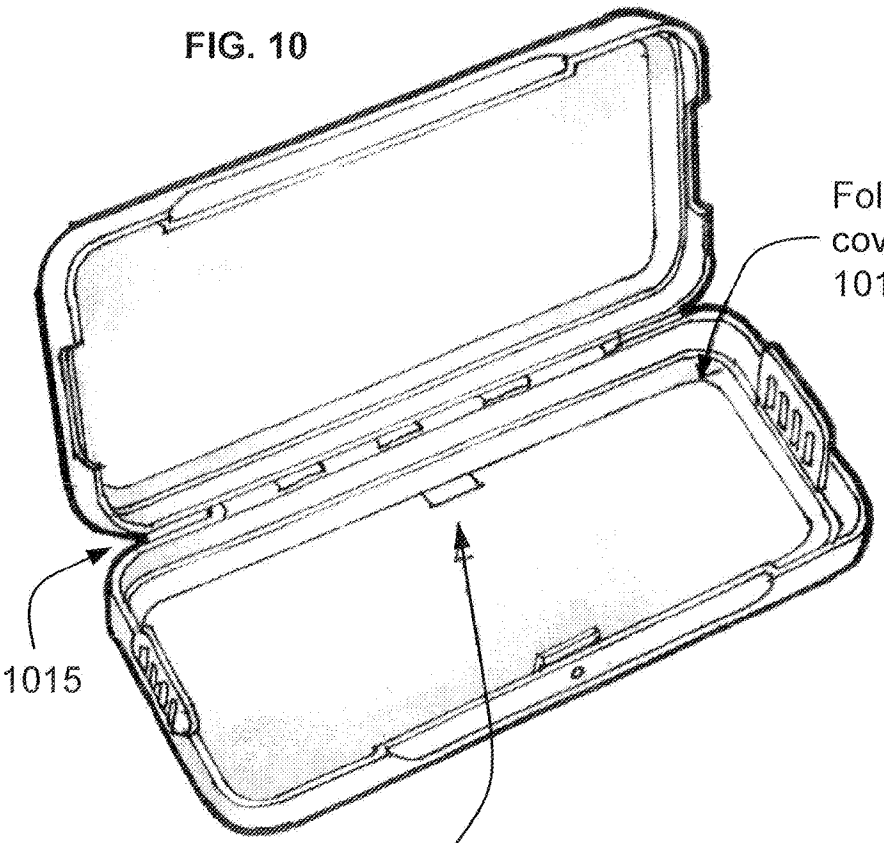
FIGS. 10-14 depict an example of an expandable footwear case, according to an embodiment of the invention.
Figure 11:
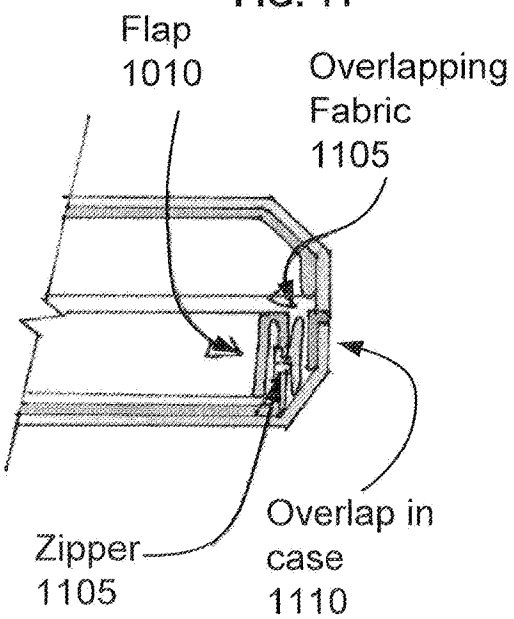
Figure 12:
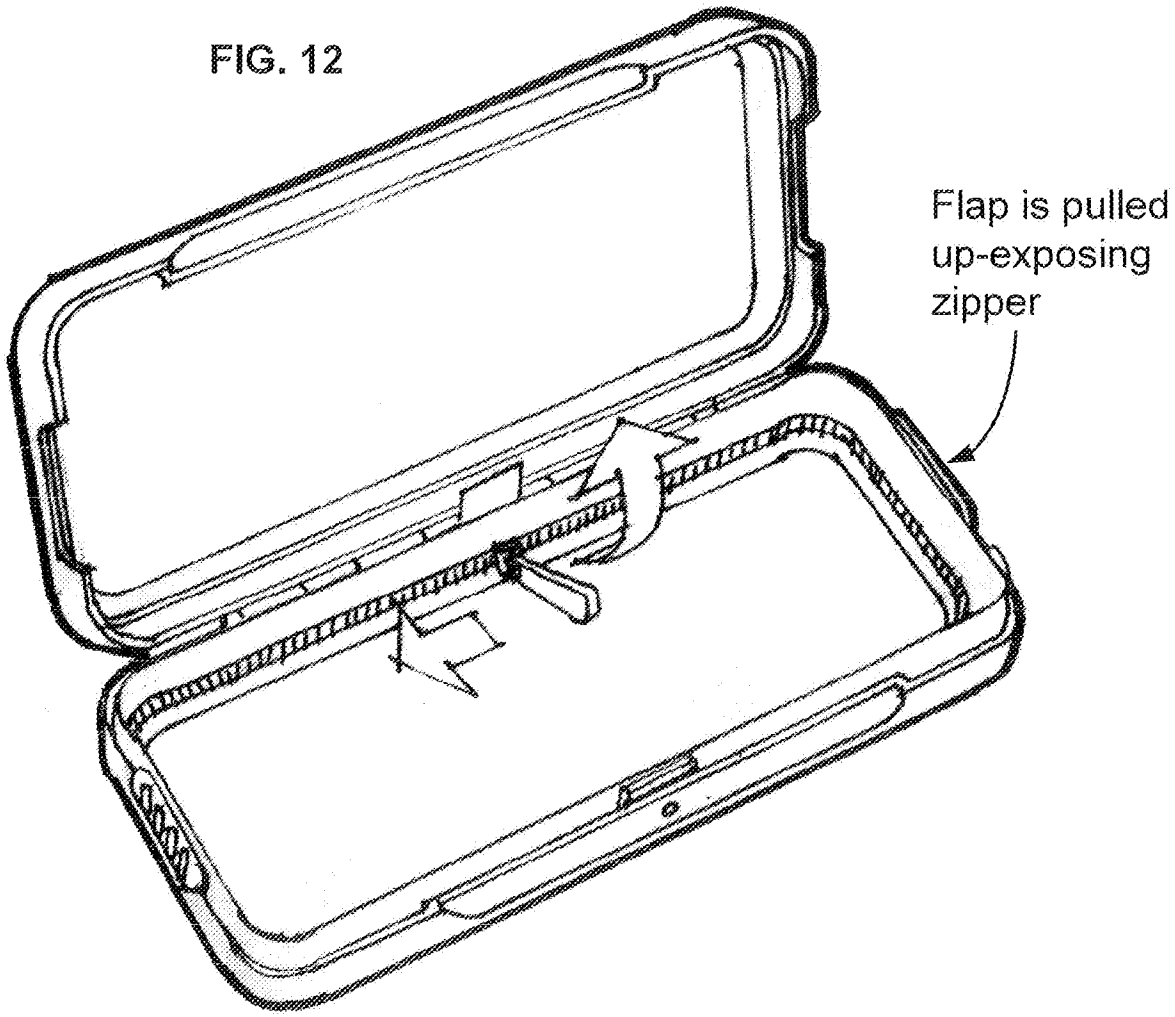
Figure 14:
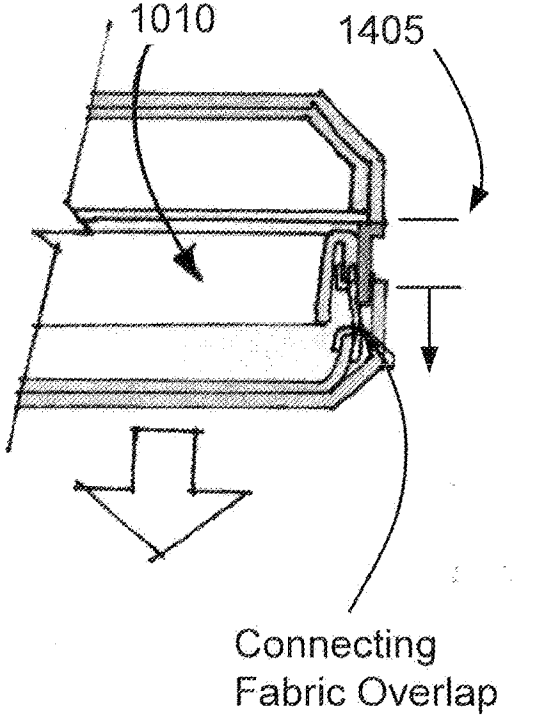
Figure 13:
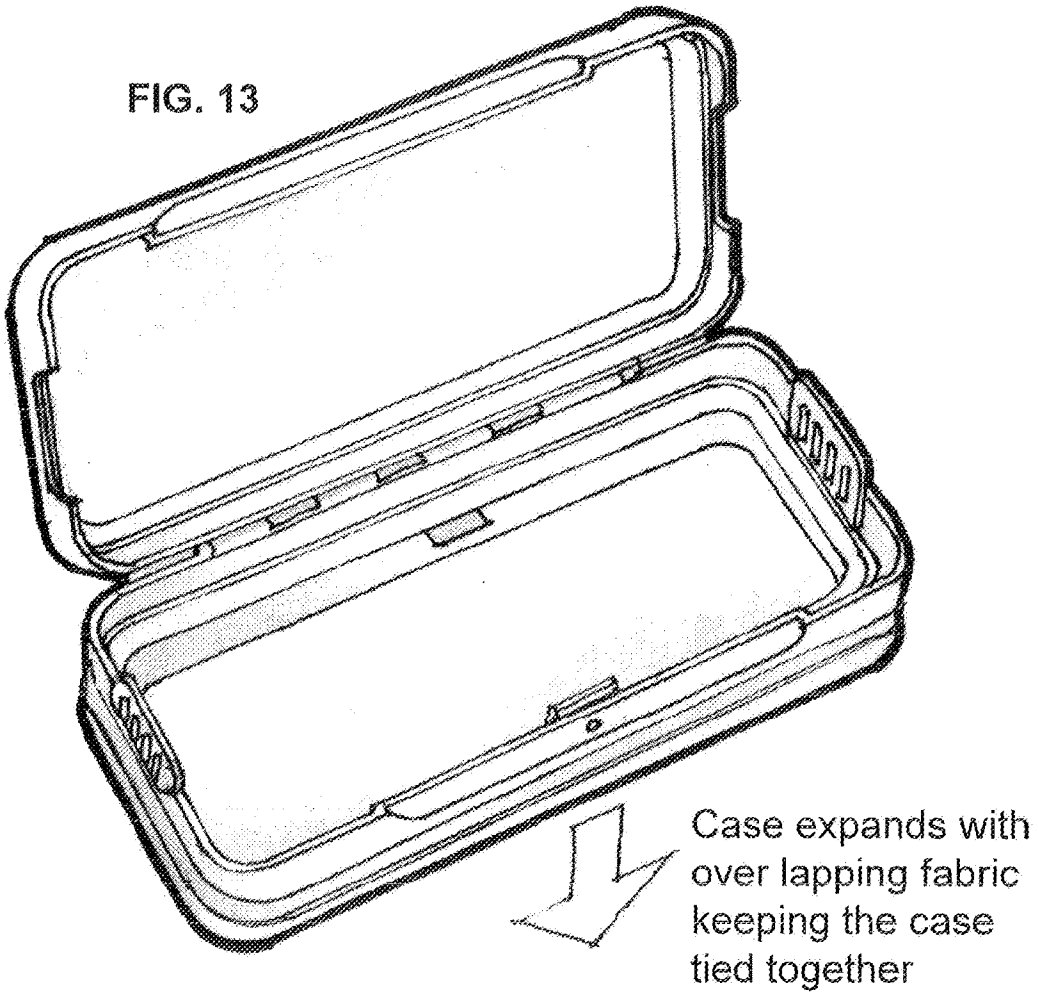
Figure 15:
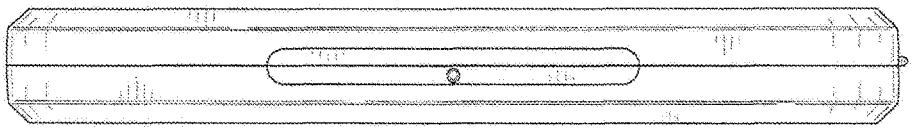
Figure 16:
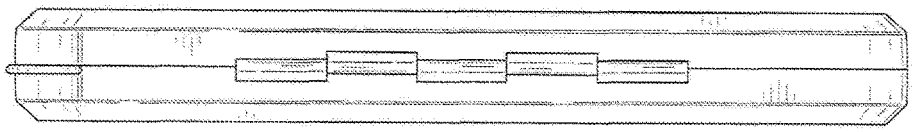
Figure 17:
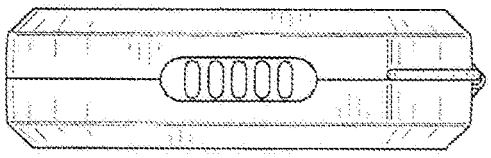
Figure 18:
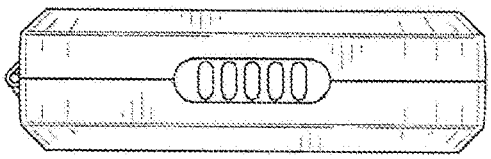
Figure 19:
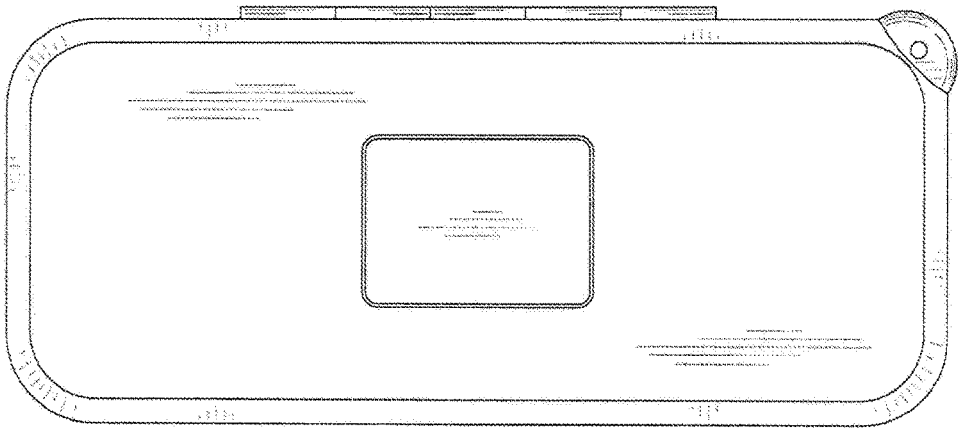
Figure 20:
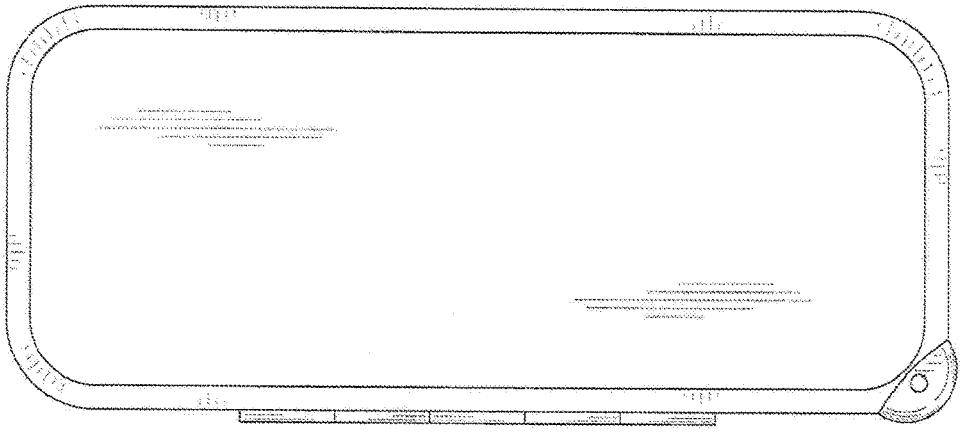

FIGS. 10-14 illustrate views of another footwear case 100, according to another embodiment. In this embodiment, the footwear case 100 is expandable. As shown in FIG. 10, a tab 1005 may be attached to the first housing 120. The tab 1005 may be used for pulling or folding up a piece of material 1010 covering a mechanism for expanding the case (e.g., zipper, VELCRO, buttons, etc.). FIG. 11 shows another view of the piece of material 1010 covering up a zipper 1105. Material 1110 is contained in FIG. 11, but, as shown in FIG. 14, material 1110 may be stretched out. FIG. 14 also illustrates expanding area 1405, which area is expanded when the mechanism for expanding the case (e.g., zipper) is utilized. FIG. 12 illustrates a view of the footwear case 100 where a zipper 1105 is exposed. FIG. 13 illustrates a view of the footwear case 100 where footwear case 100 is expanded, and the material 1105 is utilized to keep the footwear case 100 together. FIGS. 10, 12, and 13 also illustrate example hinges 1015 that may connect the first housing 110 to the second housing 120. Those of ordinary skill in the art will see that many other types of hinges or other mechanisms may be utilized to connect the first housing 110 and the second housing 120.

It should be noted that, in some embodiment, the inside and outside of the footwear case can have a name (e.g., trademark, etc.) embossed, printed, etc.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above-described embodiments.

In addition, it should be understood that any figures which highlight the functionality and advantages, are presented for example purposes only. The disclosed methodology and system are each sufficiently flexible and configurable, such that it may be utilized in ways other than that shown.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope of the present invention in any way.

It should be noted that Applicant has used the phrase "comprising" throughout the claims instead of "including, but not limited to". However, it should be noted that "comprising" should be interpreted as meaning "including, but not limited to".

It should also be noted that the terms "a", "an", "the", "said", etc. signify "at least one" or "the at least one" in the specification, claims and drawings. It should also be noted that when a plural term is utilized, a singular term may also be meant.

Finally, it is the applicant's intent that only claims that include the express language "means for" or "step for" be interpreted under 35 U.S.C. 112, paragraph 6. Claims that do not expressly include the phrase "means for" or "step for" are not to be interpreted under 35 U.S.C. 112, paragraph 6.

The invention claimed is:

1. A case comprising:

a first housing, the first housing comprising first venting formed in the first housing, the first venting comprising a first barrier facing an inside of the case and a first frame facing an outside of the case;

a second housing constructed and arranged to be attached to the first housing, the second housing comprising second venting formed in the second housing, the second venting comprising a second barrier facing the inside of the case and a second frame facing an outside of the case;

a first liner disposed on a first inner side of the first housing and a second liner disposed on a second inner side of the second housing; and a first strap attached to the first housing and a second strap attached to the second housing, the first strap and the second strap each constructed and arranged to secure a flip-flop the first and second ventings are engaged by a plurality of recesses at a peripheral edge of one of the first and second housings.

2. The case of claim 1, further comprising a hinge;

wherein the first housing is attached to the second housing with the hinge.

3. The case of claim 1, further comprising a latch comprising:

a first latch portion disposed on the first housing and;

a second latch portion disposed on the second housing;

wherein the first latch portion is constructed and arranged to interlock with the second latch portion.

4. The case of claim 1, further comprising a logo disposed on the first housing and/or the second housing.

5. The case of claim 1, wherein the first and second liners are resistant to mold, mildew, and fungus.

6. The case of claim 1, wherein:

the first inner side and/or the second inner side comprises a recess; and the first and/or second liners comprises at least one foot constructed and arranged to fit within the recess.

7. The case of claim 1, wherein the first frame and the second frame are resistant to mold, mildew, and fungus.

8. The case of claim 1, wherein the first barrier and the second barrier are resistant to mold, mildew, and fungus.

9. The case of claim 1, further comprising a divider disposed in an inside of the case, the divider constructed and arranged to be attached to the first housing and/or the second housing.

10. The case of claim 9, wherein the divider comprises a screen and a frame surrounding the screen.

11. The case of claim 10, wherein the screen is resistant to mold, mildew, and fungus.

12. The case of claim 1, wherein the first and second straps are resistant to mold, mildew, and fungus.

13. The case of claim 1, wherein the first strap comprises a first strap portion and a first strap latch portion and/or the second strap comprises a second strap portion and a second strap latch portion.

14. The case of claim 1, further comprising a hook disposed on a first outer side of the first housing and/or a second outer side of the second housing.

15. The case of claim 1, further comprising handle disposed on a first outer side of the first housing and/or a second outer side of the second housing.

16. The case of claim 1, further comprising a mechanism for expanding the size of the case.

17. The case of claim 1, wherein at least one of first and second frames comprises an opening or multiple openings.

18. The case of claim 1, wherein at least one of first and second frames comprises slits.

19. The case of claim 1, wherein at least one of first and second ventings is molded into at least one of the first and second housings.

* * * * *